US006905064B1

(12) United States Patent
Ong

(10) Patent No.: US 6,905,064 B1
(45) **Date of Patent: *Jun. 14, 2005**

(54) EXPANDING FILE WITH POCKET DIVIDER

(76) Inventor: Bon S. Ong, Box 4247, Torrance, CA (US) 90510

( * ) Notice: Subject to any disclaimer, the term of this patent is extended or adjusted under 35 U.S.C. 154(b) by 0 days.

This patent is subject to a terminal disclaimer.

(21) Appl. No.: 10/210,983

(22) Filed: Aug. 5, 2002

(51) Int. Cl.[7] ..... B65D 37/00
(52) U.S. Cl. ..... 229/67.4; 229/67.1; 229/67.3; 229/928
(58) Field of Search ..... 229/67.1, 67.3, 229/67.4, 928, 72

(56) References Cited

U.S. PATENT DOCUMENTS

| | | | | | |
|---|---|---|---|---|---|
| 325,676 | A | | 9/1885 | Jenkins | |
| 975,792 | A | | 11/1910 | Pittman | |
| 1,455,419 | A | | 5/1923 | Ahlquist | |
| 2,333,798 | A | | 3/1943 | Kner | |
| 2,729,258 | A | * | 1/1956 | Pentland et al. | 206/553 |
| 2,756,515 | A | * | 7/1956 | Hoffman | 434/159 |
| 3,399,823 | A | * | 9/1968 | Johnson | 229/72 |
| 4,129,214 | A | * | 12/1978 | Gendron | 229/313 |
| 4,262,838 | A | | 4/1981 | Mackenzie | |
| 4,274,577 | A | | 6/1981 | Walsh, Jr. | |
| 4,549,688 | A | * | 10/1985 | Ozmon et al. | 229/67.3 |
| 5,031,772 | A | * | 7/1991 | Woodriff | 206/308.3 |
| 5,050,792 | A | * | 9/1991 | Segall | 229/68.1 |
| 5,271,502 | A | | 12/1993 | Chang | |
| 5,275,438 | A | * | 1/1994 | Struhl | 281/31 |
| 5,288,144 | A | * | 2/1994 | Guderyon | 312/183 |
| 5,664,724 | A | | 9/1997 | Ho | |
| 5,873,513 | A | * | 2/1999 | Ong | 229/67.1 |
| 6,047,879 | A | * | 4/2000 | Henrikson et al. | 229/67.3 |
| 6,607,122 | B1 | * | 8/2003 | Ong | 229/67.3 |
| 6,669,080 | B2 | * | 12/2003 | Ong | 229/67.3 |

* cited by examiner

*Primary Examiner*—Robin A. Hylton
(74) *Attorney, Agent, or Firm*—Charles H. Thomas

(57) ABSTRACT

A portable, expandable file section case is equipped with file section dividers, at least some of which are provided with pockets. The file section dividers of the invention are formed of a laterally expansive partition with a pocket attached thereto. The pocket may be formed either from the same sheet of material as the file section divider partition, or from a second sheet of material. For example, the pocket may be formed by an extension of the same sheet of material that projects from the lower edge of the partition and is folded back up into contact with the divider partition. The opposing pocket panel side edges may be secured to the file section divider partition by sonic welding or some other means. Alternatively, the pocket may be formed from a second sheet of material having a generally rectilinear configuration and formed in the manner of a patch on the divider partition. The pocket is secured along its bottom edge and its opposing side edges to the divider partition. Alternatively, the second sheet of material forming the pocket may be folded in half along a pocket bottom fold that divides the second sheet into a backing panel and an apron panel. The apron panel is folded up against the backing panel and may be secured thereto or to the file section divider partition behind the backing panel. In either case the upper margin of the backing panel is suspended from the divider partition near the upper edge of the divider partition.

15 Claims, 13 Drawing Sheets

EXPANDING FILE WITH POCKET DIVIDER

BACKGROUND OF THE INVENTION

1. Field of the Invention

The present invention relates to improved file section dividers for office filing products, with particular applicability to portable, expandable filing cases.

2. Description of the Prior Art

In conventional office filing products an office file is typically divided from front to back into separate sections or compartments by a plurality of laterally extending file section dividers. Conventional file section dividers are typically formed as generally rectangular, expansive sheets of stiff but somewhat flexible material. These sheets extend from one side of the file enclosure to the other and are generally equipped with labeling tabs that project upwardly from the normally horizontal upper edge of the divider. Labeling indicia are placed on or inserted into these labeling tabs so as to identify the contents of the compartment in front of or behind the particular file section divider bearing the labeling tab. File section dividers such as these have been used for many, many years and are standard articles of office supplies.

Conventional file section dividers are somewhat deficient in that they are designed to accommodate only papers of a uniform, standard size within the filing compartments or sections to which they relate. For example, many file section dividers are constructed in a size suitable for storing within their confining compartments papers that are eight and a half inches in width and eleven inches in length. While conventional file section dividers are quite adequate for this purpose, the need often arises for storing papers or other articles formed in a different size within filing compartments designed to receive papers of the particular standard size for which the file section dividers are designed. Smaller papers and articles can thereby easily become crumpled or overlooked when stored in compartments delineated by conventional file section dividers, due to their relatively small size. Smaller papers and other articles stored between conventional file section dividers can also easily overlooked.

This problem is particularly acute in the case of portable, collapsible files where the access to each file section compartment may be rather limited. Small notes and other papers can easily drop down between the larger papers for which the file is designed. The inability to locate such smaller documents and other articles within a portable, expandable filing case represents a course of continuing frustration and annoyance to persons utilizing such articles.

SUMMARY OF THE INVENTION

A primary object of the present invention is to provide file section dividers for office filing products that are equipped with pockets or pouches designed to receive articles that are smaller in size than the papers or documents that the file section dividers are designed to separate. By providing a pouch or pocket on the surface of improved file section dividers according to the invention, the user of the file is able to more quickly and expeditiously locate undersized documents and papers within a filing compartment.

In one broad aspect the present invention may be considered to be an improvement in a fill section divider formed as an expansive partition and having a laterally extending upper edge from which a file section label tab projects upwardly; an opposing, laterally extending lower edge parallel to the upper edge; and mutually parallel opposing side edges oriented perpendicular to the upper and lower edges. The improvement of the invention is comprised of a pocket secured to the expansive partition. The pocket has a top opening located beneath the level of the label tab.

The pocket may be formed in several different ways. In one preferred embodiment of the invention the pocket is formed by a rectilinear patch secured to the partition. The patch has mutually parallel closed side edges that are parallel to the partition side edges and located therebetween, and a closed bottom edge parallel to and located above the bottom edge of the expansive partition. The side and bottom edges of the patch may be closed by different securement systems, including sonic welding, adhesive, staples, tape, and many other conventional fasteners. Where the partition and pocket are both formed of thin sheets of plastic material, such as polyethylene or polypropylene, the side and bottom edges of the patch forming the pocket are most easily and economically secured by sonic welding throughout to the divider partition.

In an alternative embodiment, the expansive partition and the pocket may be formed from a common sheet of material folded at a bottom edge fold which defines the lower edge of the partition and creates a delineation between the partition and the pocket. The pocket is thereby formed as an extension from the lower edge of the partition. The pocket has mutually parallel side edges that are parallel to the side edges of the partition. Very typically the side edges of the pocket are spaced closer together than the side edges of the partition so that the partition is wider than the pocket. In such devices the side edges of the pocket are normally secured throughout their lengths to the partition so that the bottom of the pocket is closed by the bottom edge fold and the sides are secured by sonic welding or other conventional fastening means.

The pocket does not necessarily need to be formed from the same sheet of material as the partition. In other embodiments of the invention the partition is formed of a first sheet of material and the pocket is formed of a separate, second sheet of material. The second sheet of material has an anchored edge parallel to and secured to the upper edge of the partition. The second sheet of material may be folded back upon itself to form a pocket bottom fold parallel to the upper anchored edge. As a result, the pocket is delineated into an apron panel and a backing panel, both having opposing side edges parallel to the side edges of the partition. The side edges of the apron panel and the backing panel may reside in registration with each other, in which case they are sealed together. The pocket is thereby secured to the partition only at the anchored edge of the pocket, so that the bottom of the pocket may be swung away from the file section divider partition.

On the other hand, the side edges of the apron panel may extend beyond and may be located further from each other than the side edges of the backing panel, and closer to each other than the side edges of the partition. In this case the side edges of the apron panel are sealed to the partition laterally outwardly from the side edges of the backing panel. The pocket is thereby secured to the partition by the side edges of the apron panel, as well as at the anchored edge of the pocket. In such embodiments, the backing panel of the pocket is held against the partition.

The invention has particular applicability to portable document storage devices. The invention may also therefore be considered to be an improved portable document storage device. Such an improved device according to the invention is formed with a case including front and back covers and a plurality of file section dividers having mutually parallel upper and lower divider edges and opposing, mutually parallel divider side edges oriented perpendicular to the upper and lower divider edges. The file section dividers are joined at the divider side edges to delineate the case into a plurality of filing compartments. According to the improvement of the invention, at least some of the file section dividers are provided with upwardly opening pouches, and each of the pouches is secured to a separate one of the file section dividers between the side edges thereof.

The invention also has particular applicability to an expandable filing case. Such a filing case has a front cover and a back cover, both having a top and a bottom. The filing case also has a plurality of filing section dividers having opposing, mutually parallel, upper and lower divider edges and opposing, mutually parallel divider side edges oriented perpendicular to the upper and lower divider edges. The divider side edges are coupled to the front and back covers with a plurality of accordion folding pleated connections. The bottom edges of the section dividers are closed, thereby forming a plurality of filing compartments between the section dividers and the front and back covers. At least some of the file section dividers are provided with filing pockets secured thereto and located between the divider side edges. Each of the filing pockets has an upwardly opening mouth located no higher than the upper divider edges.

The invention may be described with greater clarity and particularity by reference to the accompanying drawings.

DESCRIPTION OF THE EMBODIMENTS

Figure 1:
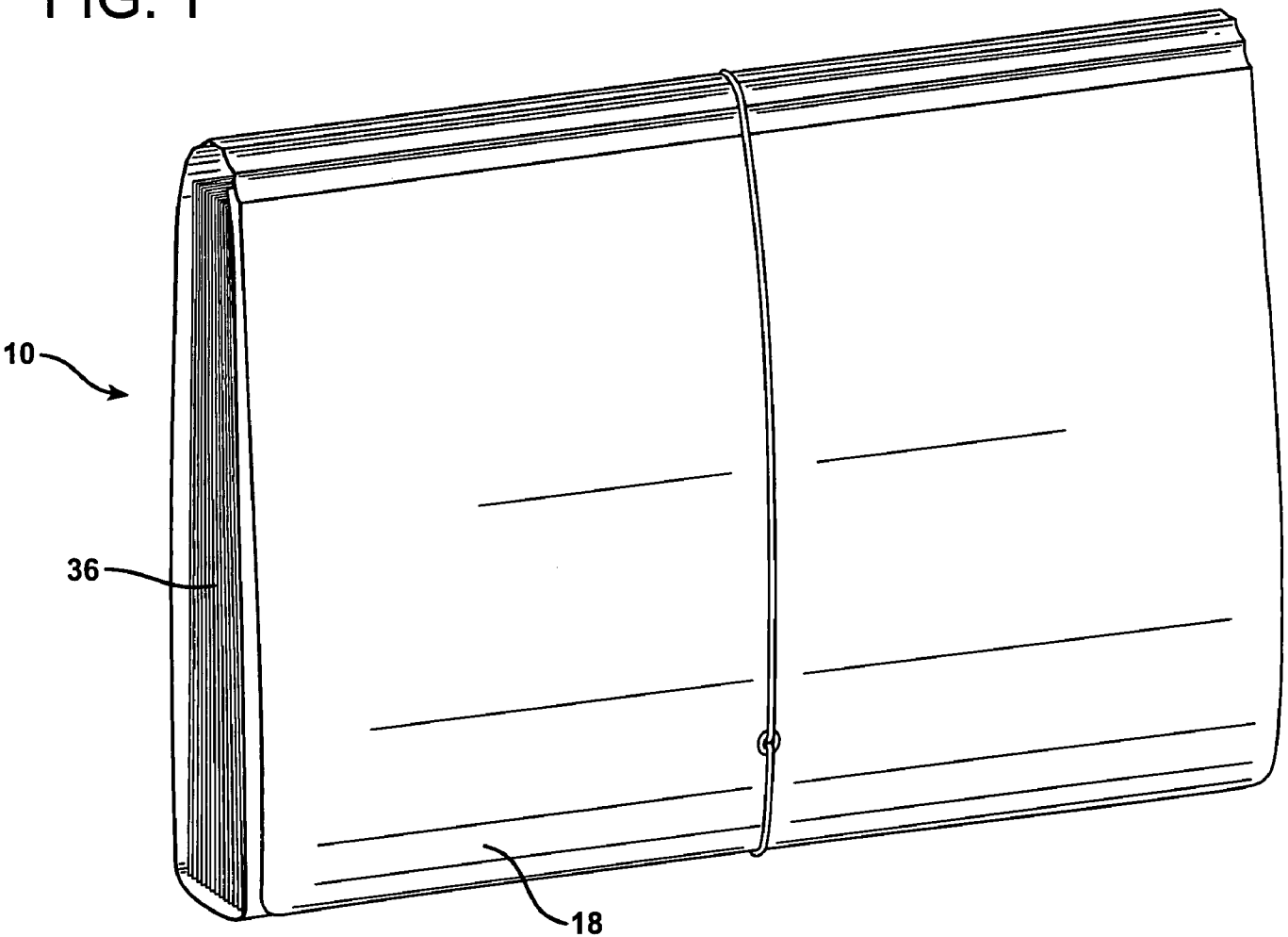
FIG. 1 is a perspective view of an expandable filing case including improved file section dividers formed according to the present invention, in which the expandable filing case is shown in a collapsed condition with its cover closed.

FIG. 1 illustrates a portable, expandable filing case 10 which is formed as a wallet-stye document storage device. The filing case 10 has a large, generally rectangular front cover 12, visible in FIG. 2, and a large, generally rectangular back cover 14, shown in FIG. 3. The front cover 12 and back cover 14 of the filing case 10 are connected together at their lower edges by a bottom panel 16. A covering flap 18 projects upwardly from the upper edge of the back cover 14 and folds over the front cover 12 when the filing case 10 is fully collapsed, as illustrated in FIG. 1. The back cover 14 has a top 20 and a bottom 22, while the front cover 12 has a top 24 and a bottom 26.

Figure 2:
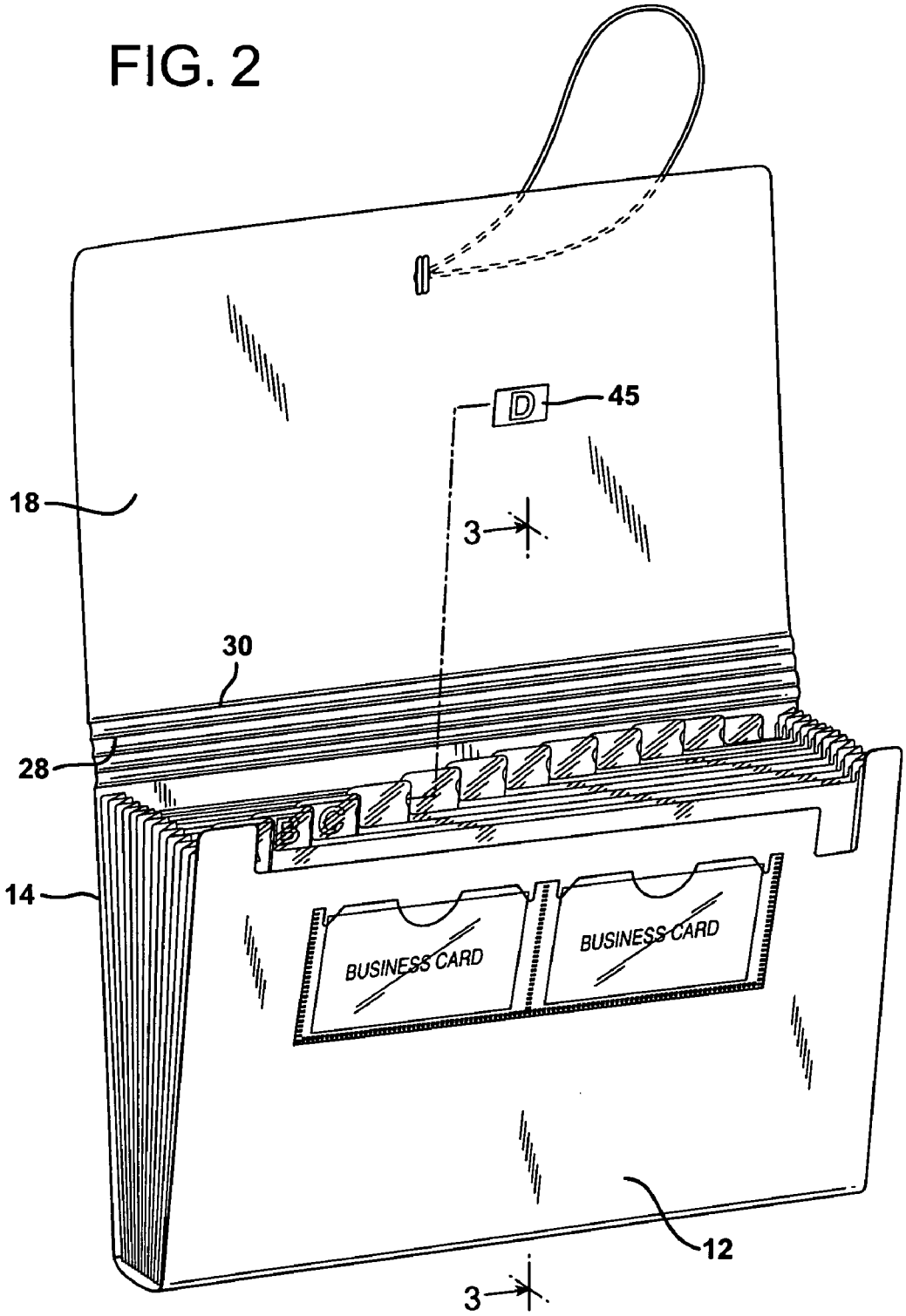
FIG. 2 is a perspective view of the filing case of FIG. 1 shown with the cover open and with the file compartments partially expanded.
Figure 3:
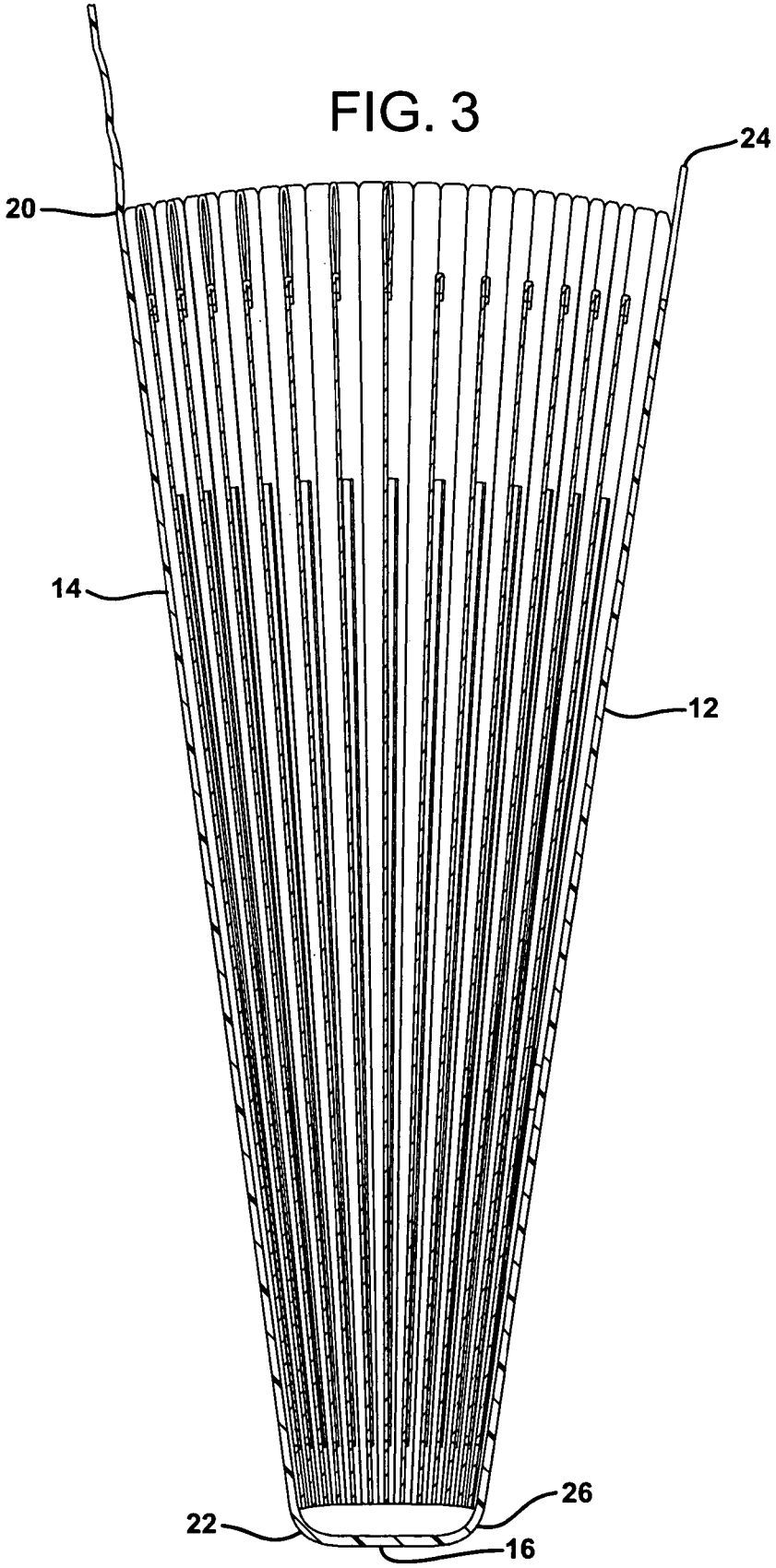
FIG. 3 is a sectional elevation view taken along the lines 3—3 of FIG. 2.

In the embodiment of the portable, expandable filing case 10 illustrated in FIGS. 1–3, the filing case front cover 12, bottom panel 16, back cover 14, and folding flap 18 are all formed as parts of a single sheet of stiff paperboard material or of a stiff sheet of plastic material, such a polypropylene or polyethylene. This stiff base sheet is folded to delineate the filing case back cover 14 and the filing case foldable flap 18 and also an articulated top panel 28 located between the filing case closure flap 18 and the filing case back cover 14. A fold at the top edge 20 of the back cover 14 delineates the back cover 14 from the top panel 28. An articulated fold at 30 delineates the top panel 28 from the closure flap 18. The top panel 28 has a series of articulated folds so as to better accommodate various thickness of documents stored within the filing case 10.

The filing cases 10 and 10' are each provided with a pair of mutually opposing side panels 36, which are each formed of separate sheets of flexible material folded with upright accordion folded pleats. The filing case side panels 36 have narrow, upright, folded margin strips at their forward ends that are secured by adhesive or sonic welding to the inside surface of the front cover 12 from top to bottom. Likewise, the pleated side panels 36 also have narrow, upright margin strips at their rear ends that are similarly secured to the inside surface of the back cover 14 just within the lateral edges thereof. The sides of the filing case 10 are closed by the side panels 36. The plurality of vertical accordion folds in the panels 36 permit expansion of the top of the filing case 10 when the covering flap 18 is opened as illustrated in FIG. 3.

Figure 4:
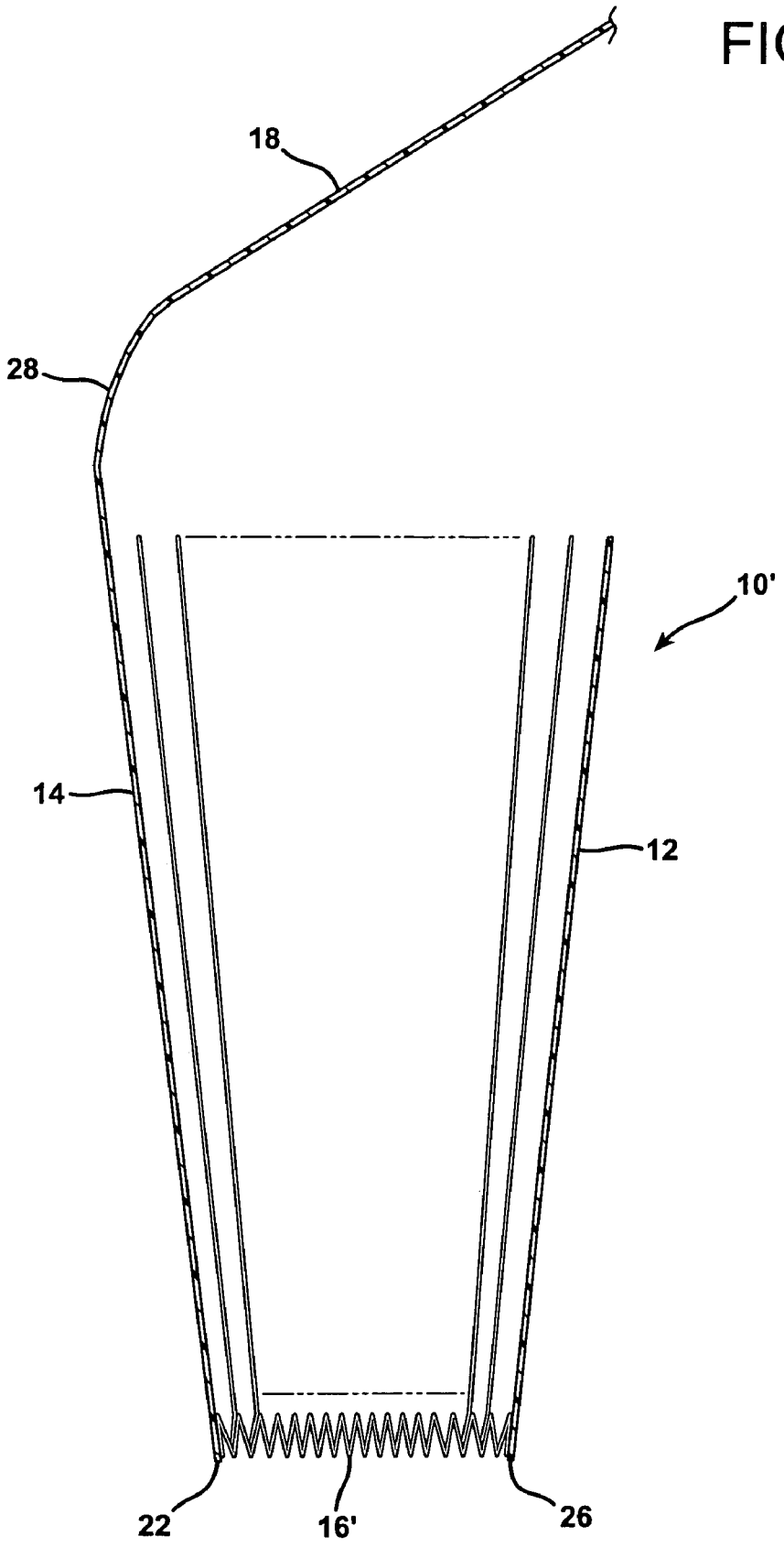
FIG. 4 illustrates an alternative embodiment of an expandable filing case to that illustrated in FIGS. 1–3.

The filing case 10' illustrated in FIG. 4 is similar in construction to the filing case 10, and components common to both filing cases bear the same reference numbers. The filing 10' differs from the filing case 10 in that the filing case front cover 12 of the filing case 10' is formed of a separate, second, stiff, plastic base sheet of the same material that forms the filing case back cover 14, top panel 28, and covering flap 18. In the filing case 10' the bottom panel 16' is formed as an independent sheet of material folded in accordion fashion and laterally secured throughout along its front edge to the inside of the front cover 12 near the bottom edge 26 thereof. The back edge of the accordion folded bottom panel 16' is secured throughout to the inside surface of the back cover 14 near the lower edge 22 thereof. The difference in construction of the filing case 10' from the filing case 10 is that both the top and bottom of the enclosure of the filing case 10' are expandable, while in the embodiment of FIGS. 1–3, only the top of the filing case 10 is expandable.

Both the filing case 10 and the filing case 10' may employ all of the different embodiments of file section dividers according to the invention, including those illustrated in FIGS. 5–9A. The filing case 10 may include a plurality of file section dividers 38, one of which is shown in isolation in FIG. 5. Each file section divider 38 is formed as an expansive partition 40 having a laterally extending upper edge 42 from which a file section label tab 44 projects upwardly, and an opposing, laterally extending lower edge 46, parallel to the upper edge 42. The partition 40 is formed of a first sheet of flexible, expansive, polyethylene, polypropylene, or card stock. Each file section divider partition 40 also is formed with mutually parallel, opposing side edges 48 and 50 which are oriented perpendicular to the upper edge 42 and the lower edge 46.

Each of the dividers 38 has outboard side edges 39 and 41. Edge margin strips 43 are formed immediately adjacent the outer edges 39 and 41 by folding the divider partitions 40 longitudinally along the fold demarcations 48 and 50, which then become the partition side edges. The marginal strips 43 of the dividers 38 are secured by adhesive, heat sealing, or sonic welding to the facing surfaces of the accordion pleated folds formed in the filing case side panels 36.

According to the improvement of the invention, the file section divider 38 is further comprised of a pocket 50 secured to the expansive partition 40 of the file divider 38. The pocket 50 has a top opening at its upper edge 52 that is located beneath the level of the label tab 44. In the embodiment of the invention illustrated in FIG. 5, each pocket 50 for each of the file sections dividers 38 is formed by a rectilinear patch from a second sheet of flat, expansive material distinct from the flat sheet of material forming the partition 40 of the file section divider 38. The patch forming the pocket 50 has a closed bottom edge 54 that is parallel to the open, upper edge 52 and mutually closed side edges 56 and 58. The closed edges 54, 56, and 58 are secured to the partition 40 by sonic welds or heat seals indicated at 59.

Figure 5:
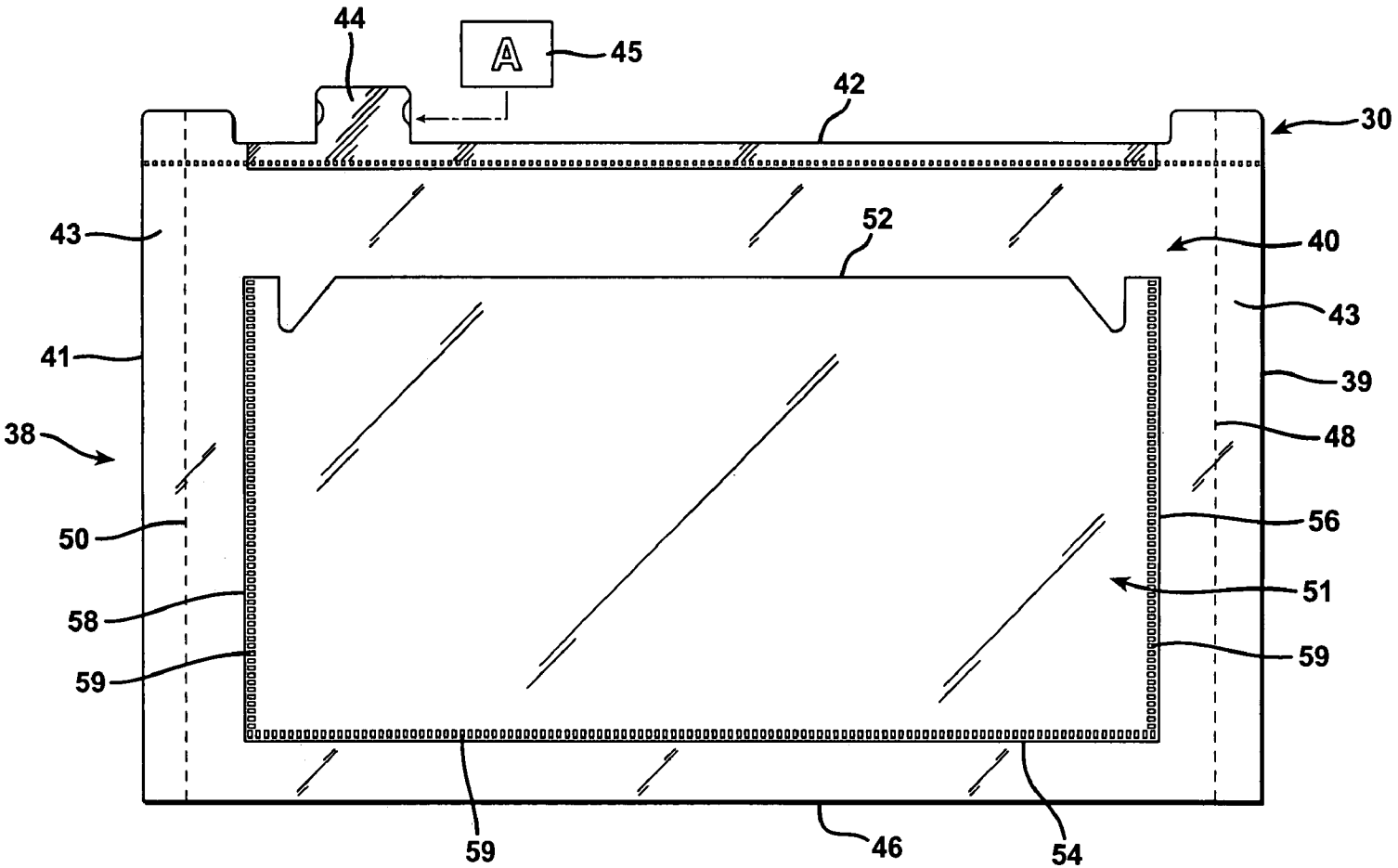
FIG. 5 is a front elevational view illustrating one improved embodiment of a file section divider according to the invention.

As illustrated in FIG. 5, the pouch panel bottom edges 54 of the dividers 38 are parallel to and located above the lower divider edges 46. The opposing pouch panel side edges 56 and 58 are parallel to and located between the divider partition side edges 48 and 50. The second sheets of material forming the pouches or pockets 50 are open at their top edges 52 to allow the insertion and removal of small documents and other articles into the pocket or pouch cavity delineated between the pouch panel 50 and the underlying divider partition 40.

Figure 6:
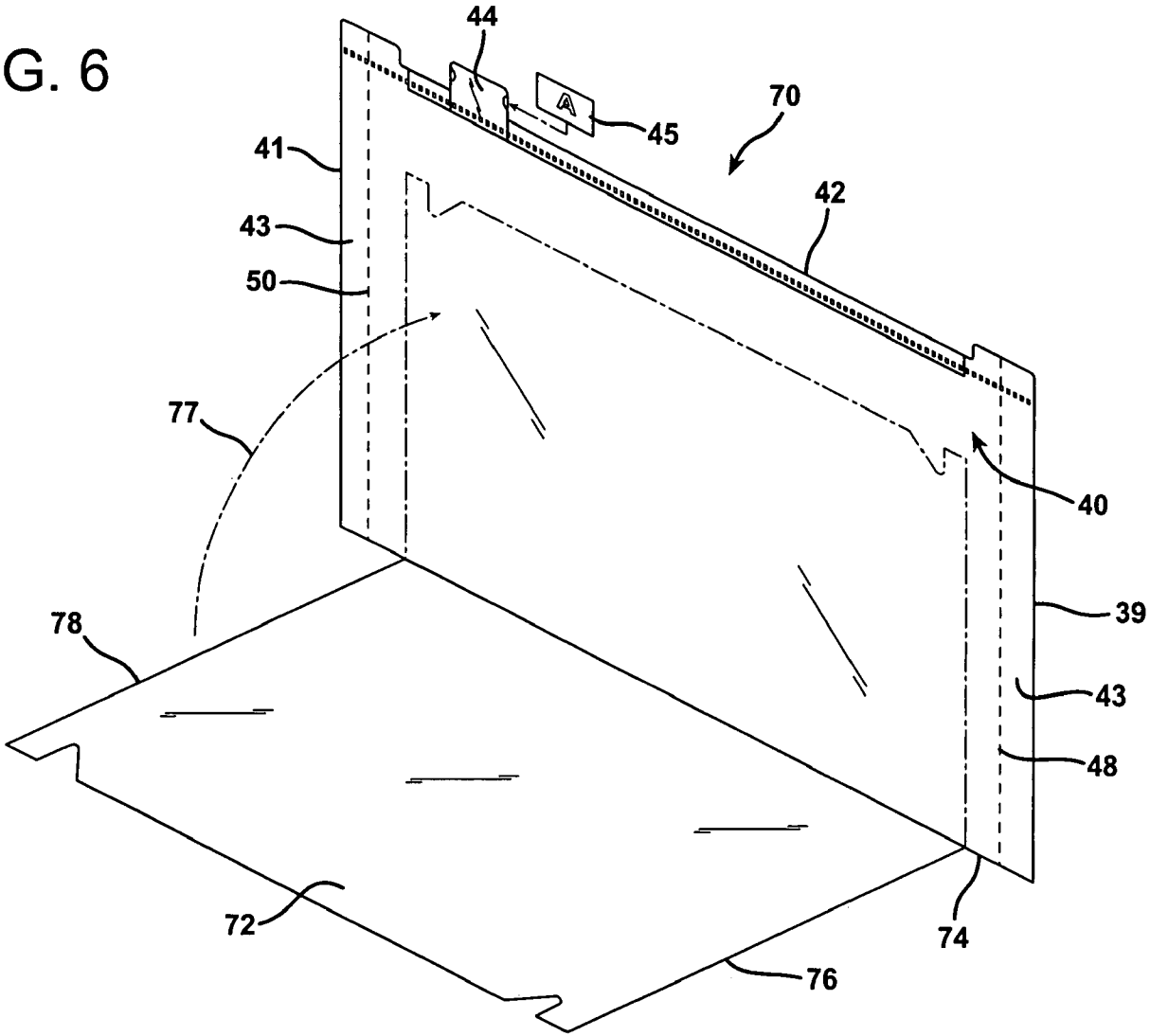
FIG. 6 is a perspective view illustrating one alternative embodiment of a filing section divider according to the present invention, shown in a condition prior to completion of fabrication.
Figure 6A:
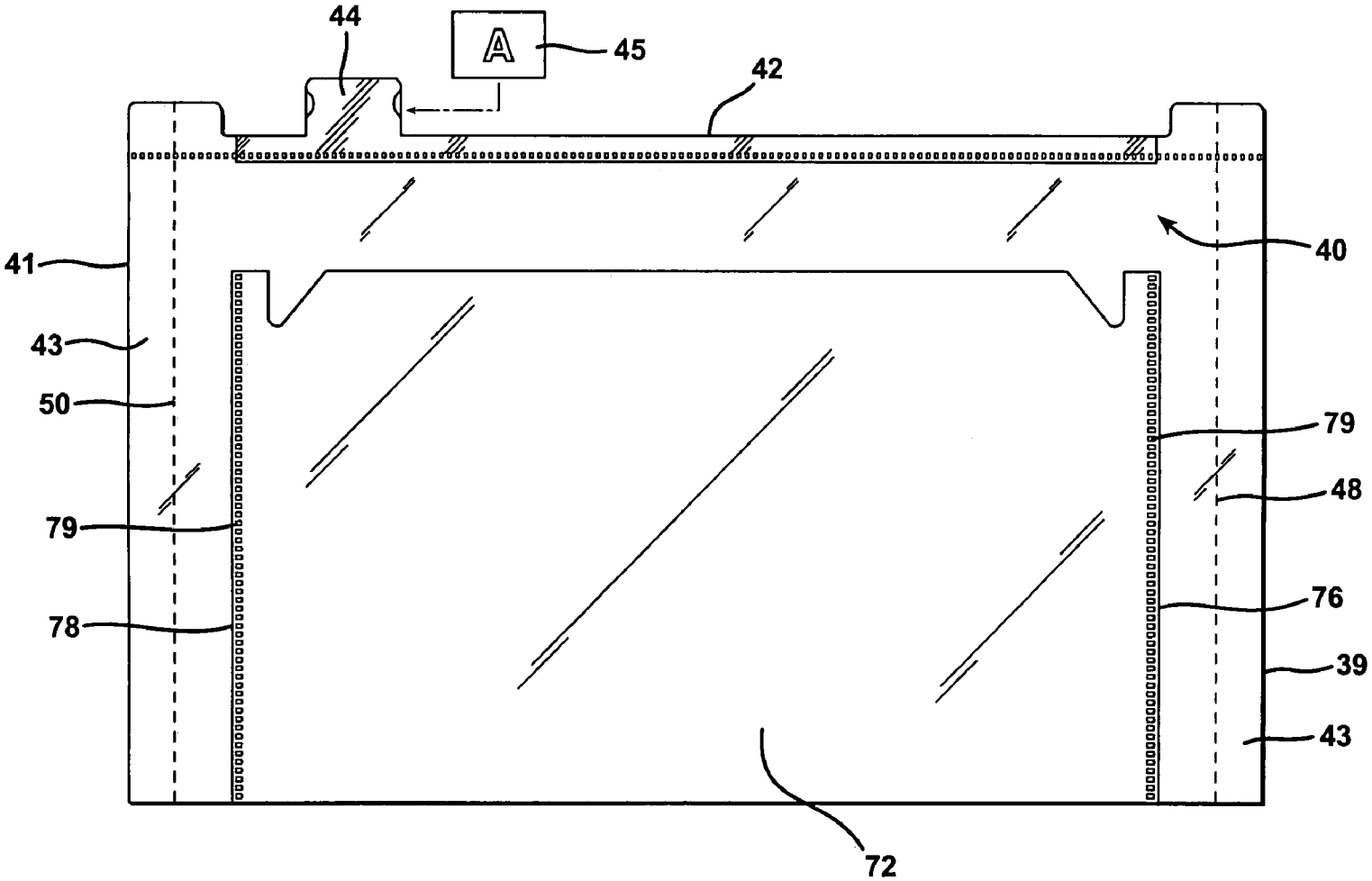
FIG. 6A is a front elevational view illustrating the file section divider shown in FIG. 6 upon completion of fabrication.

FIGS. 6 and 6A illustrate an alternative embodiment of a file section divider 70 according to the invention. Like the divider section 38, the divider section 70 is formed with a straight, generally horizontal upper edge 42 from which a file section label tab sleeve 44 projects upwardly. The filing tabs 44 are formed as hollow sleeves designed to receive printed indicia, such as paper labels 45 that are inserted between the two layers of the filing tab sleeves 44. The file section dividers 70 are also formed with outboard edges 39 and 41 and edge margin strips 43 that are folded at the divider partition side edges 48 and 50 and secured to the filing case side panels 36, as in the file section divider 38.

Each file section divider 70 differs significantly from the file section divider 38, however, in that the pocket panel 72 thereof is formed as an extension panel projecting from the divider partition 40 at the lower edge 74 thereof. The extension forming the pocket panel 72 is narrower in width than the partition 40 delineated by the upper portion of the folded sheet forming the index divider 70. The pocket panel 72 has opposing pouch panel side edges 76 and 78 that are located inboard from the partition divider side edges 48 and 50 and are oriented perpendicular to the lower edge 74 of the partition 40. As indicated by the directional arrow 77 in FIG. 6, the pouch panel 72 of each of the file section dividers 70 is folded back up against the portion of the sheet forming the partition 40. The pouch panel side edges 76 and 78 are secured throughout their lengths to the dividers 70 by linearly extending ultrasonic welds 79, as illustrated in FIG. 6A. The pockets formed between the pocket panels 72 and the partitions 40 are thereby closed along the bottom of the pocket formed by the fold between the panel extension 72 and the partition 40 at the lower edge 74 and by the sealed side edges 76 and 78 of the pouch panel 72. As illustrated in FIG. 6A, the pouch panel side edges 76 and 78 are spaced inboard from the divider side edges 48 and 50 that form the lateral extremities of the partition 40.

Figure 7:
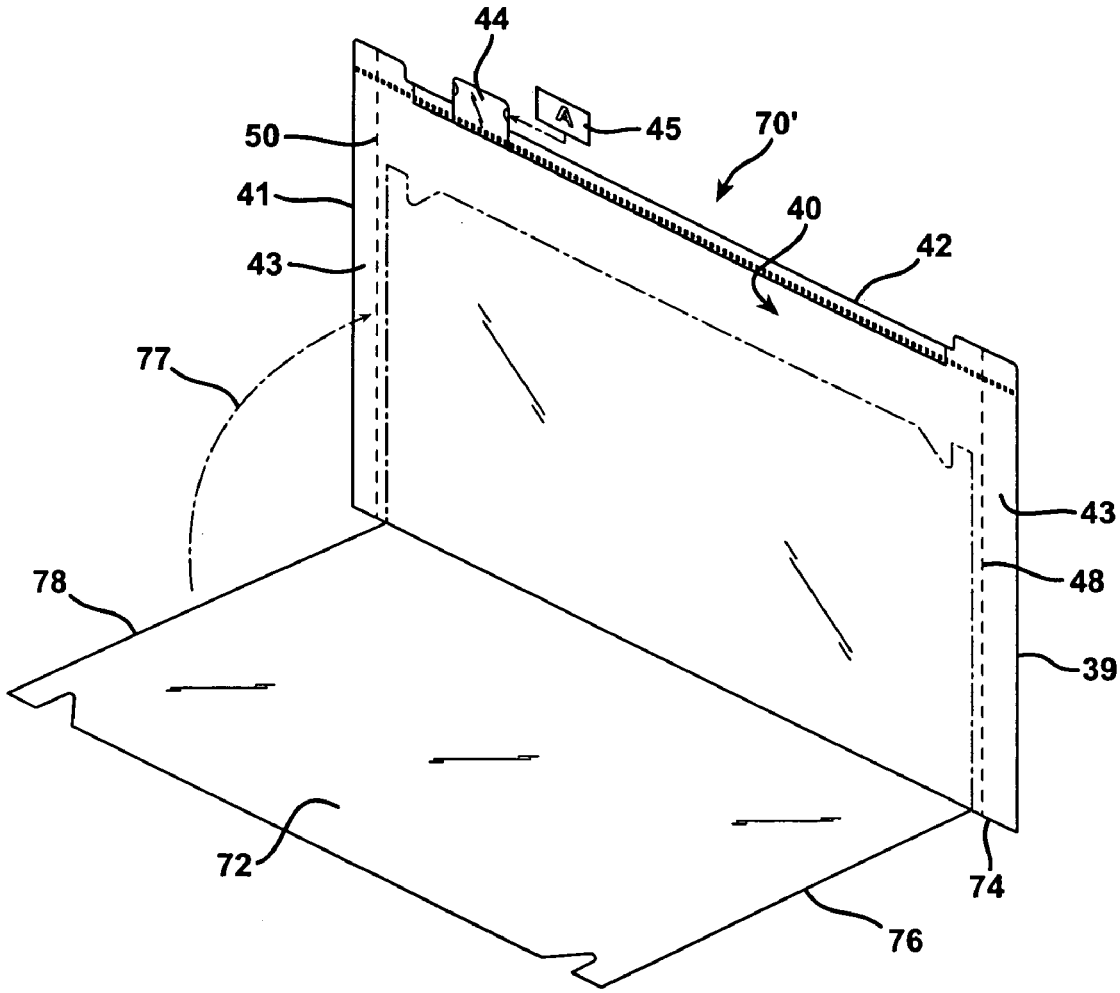
FIG. 7 is a perspective view illustrating another alternative embodiment of an improved file section divider according to the invention prior to completion of fabrication.
Figure 7A:
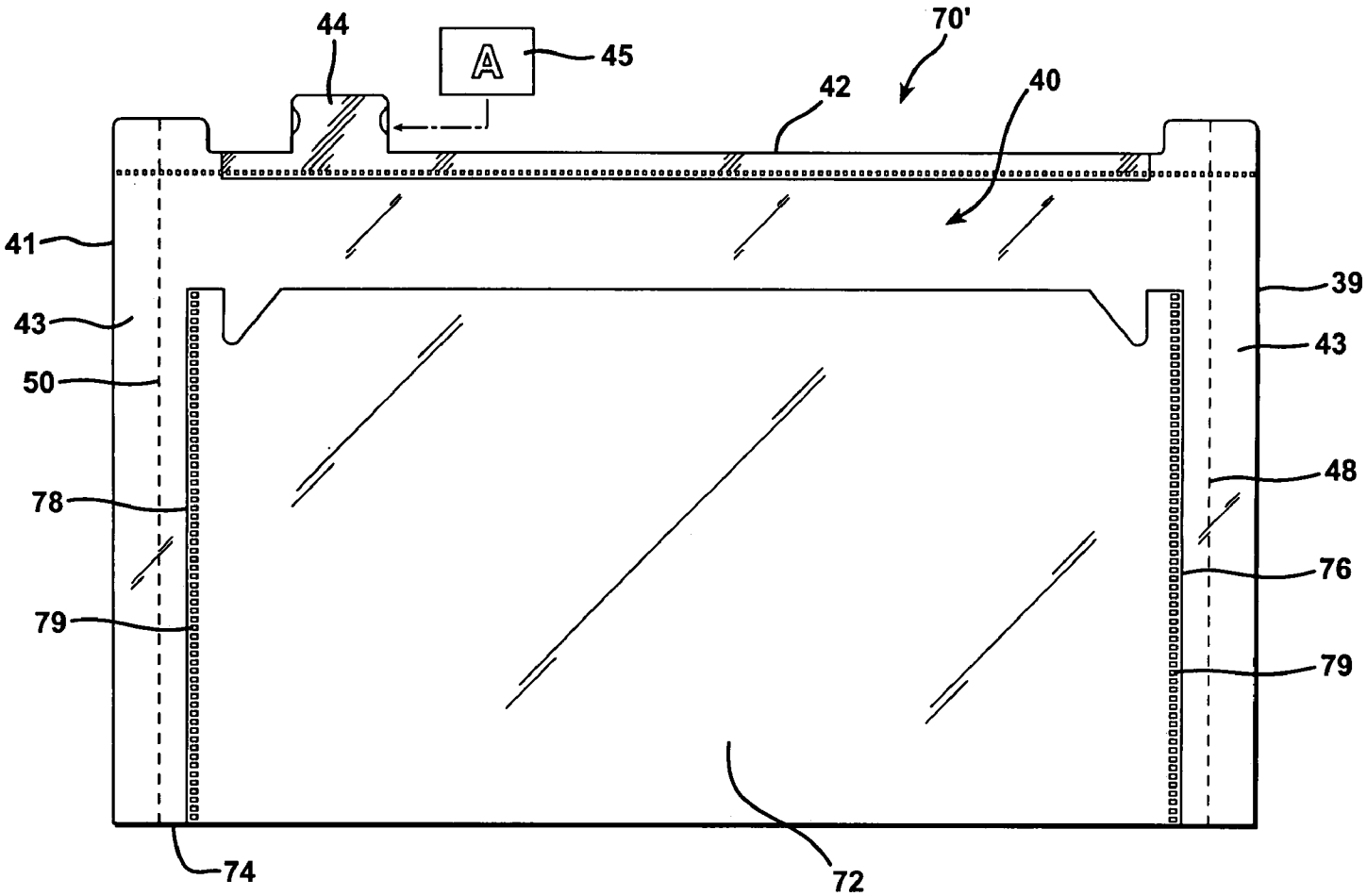
FIG. 7A is a front elevational view of the file section divider shown in FIG. 7 after completion of fabrication.

FIGS. 7 and 7A illustrate an alternative embodiment of the invention in which file section dividers 70' are employed. The file section dividers 70' differ from the file section dividers 70 only in that the pouch panel side edges 76 and 78 extend in an outboard direction almost to the partition divider side edges 48 and 50. The file section dividers 70' are otherwise identical in construction to the file section dividers 70.

Figure 8:
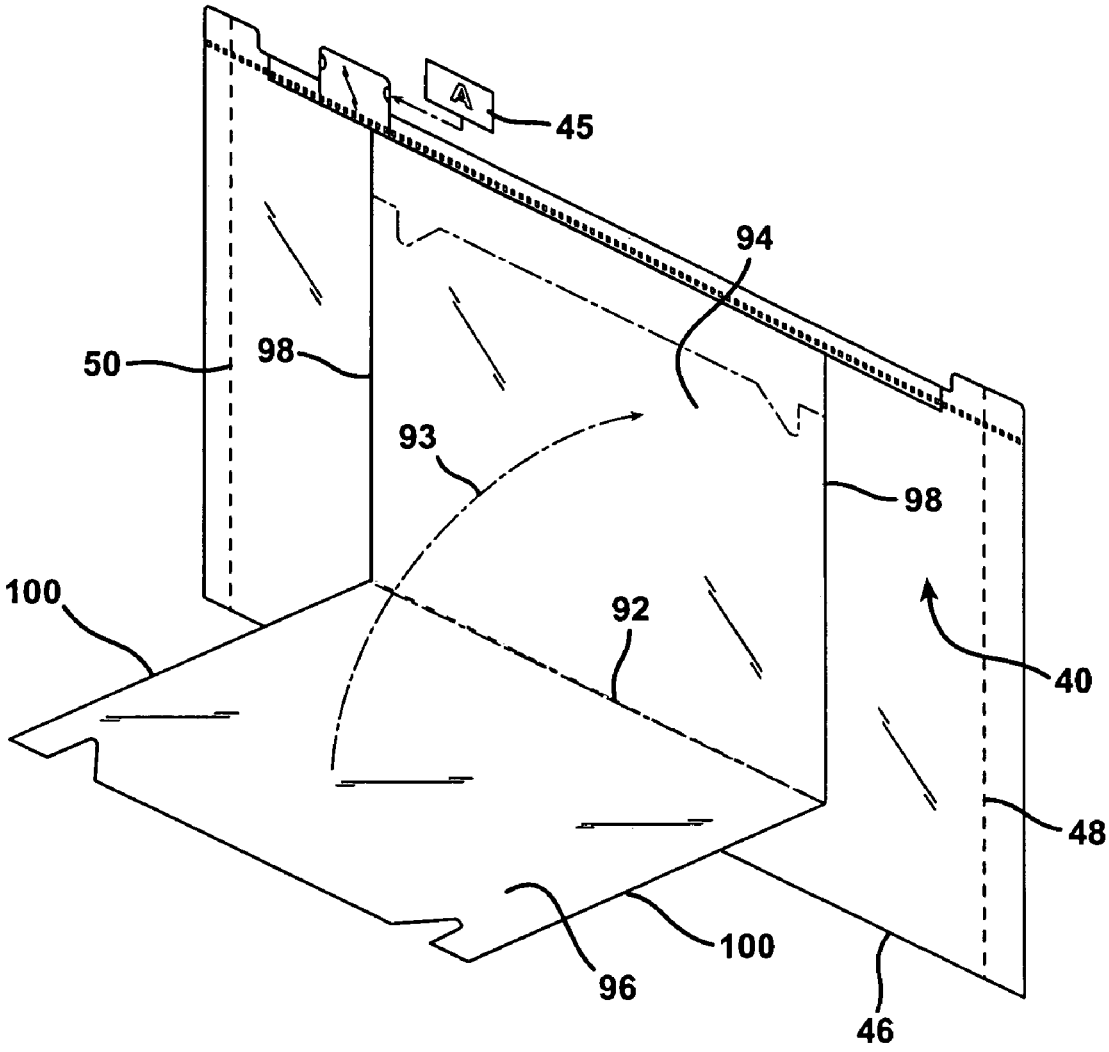
FIG. 8 is a perspective view illustrating another alternative embodiment of an improved file section divider according to the invention prior to completion of fabrication.
Figure 8A:
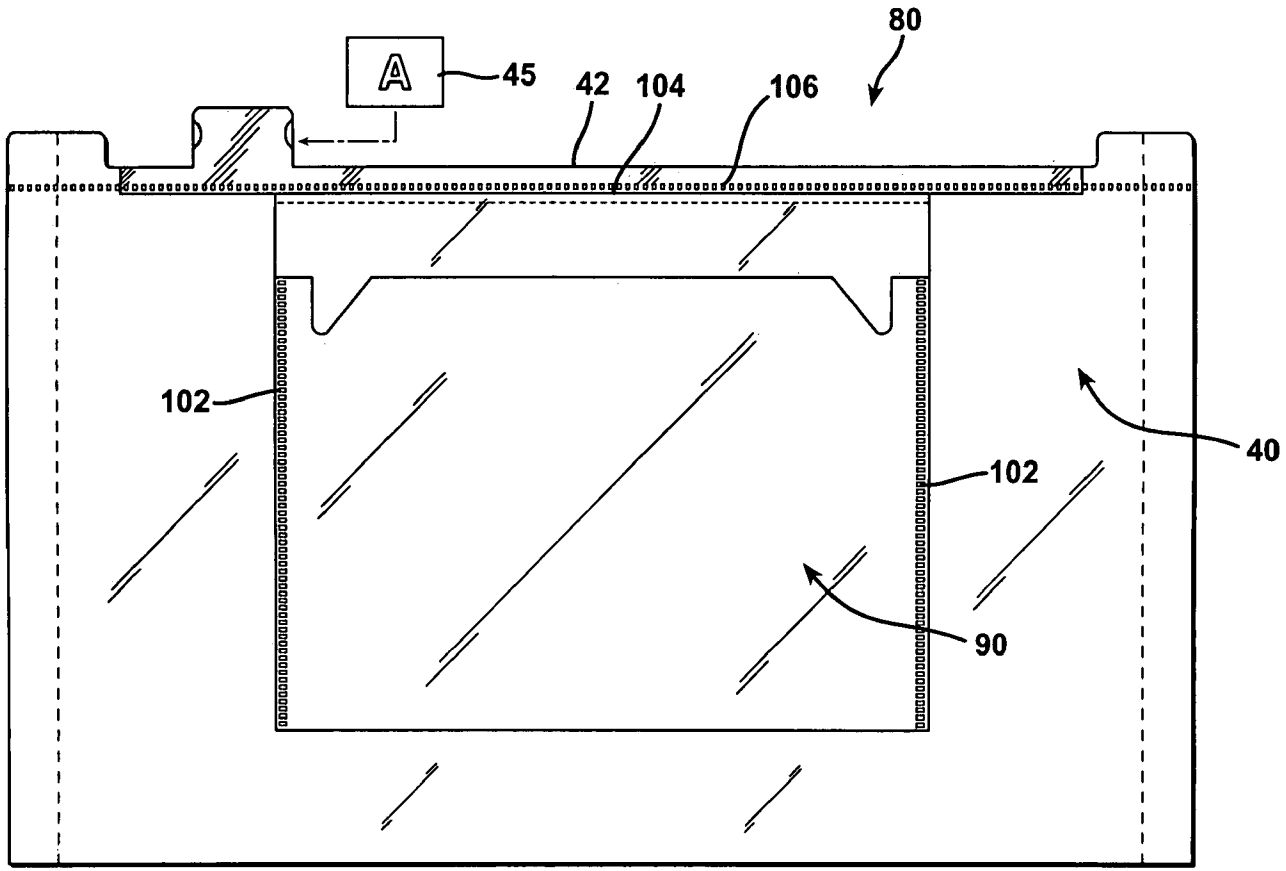
FIG. 8A is a front elevational view of the file section divider shown in FIG. 8 after completion of fabrication.

FIGS. 8 and 8A illustrate an alternative embodiment of the invention in which file sections dividers 80 are employed in either the portable, expandable filing case 10 of FIGS. 1–3 or the portable, expandable filing case 10' illustrated in FIG. 4. Each partition 40 is constructed in the identical manner depicted and described with reference to FIG. 5.

The pocket or pouch 90 is formed of a second sheet of flexible, expansive material distinct from the first sheet of material forming the partition 40. The pocket or pouch 90 of the file section divider 80 differs significantly from the pocket panel 50 in its construction, however. Specifically, the second sheet of material is initially flat, but is folded along a pouch panel bottom edge 92 along a fold line that is parallel to and located above the lower file section divider edge 46 of the partition 40. The second sheet forming the pocket or pouch 90 is folded at the bottom edge fold line 92 upwardly, as indicated by the directional arrow 93, so as to form a backing panel 94 separate from the partition 40 and also an apron panel 96. The backing panel 94 and apron panel 96 are laterally coextensive so that the backing panel 94 defines straight, linear backing panel side edges 98 located inboard from the partition side edges 48 and 50. The apron panel 96 defines opposing apron panel side edges 100, which are also straight, linear, and are spaced from each other the same distance that the backing panel side edges 98 are spaced from each other. Each pouch panel bottom edge 92 is thereby located above the corresponding lower partition divider edge 46. The backing panel side edges 98 and the apron panel side edges 100 are all parallel to and located laterally within the divider partition side edges 48 and 50. The backing panel side edges 98 and the apron panel side edges 100 are aligned in mutual registration and are sealed to each other by linear sonic welds 102, as illustrated in FIG. 8A.

The backing panels 94 of the file section dividers 80 have top, anchoring margins 104 that are sealed to the divider partitions 40 by linear, laterally extending sonic welds 106, as illustrated in FIG. 8A. The top anchoring margins 104 of the backing panels 94 are sealed to the divider partitions 40 at the upper edges 42 thereof. The pouches or pockets 90 are thereby attached to the divider partitions 40 only by the linear seals 106 that exists at the upper anchoring margins 104 of the backing panels 94. The pockets 90 thereby hang in depending fashion from the upper edges 42 of the divider partitions 40 and may be swung away from the surfaces of the divider partitions 40. Papers and other documents of a size larger than the pockets 90 may thereby be inserted in between the back side of the backing panels 94 and the facing surfaces of the divider partitions 40. The pockets 90 thereby serve the dual purpose of providing receptacles for smaller papers or other articles and acting as retainers for papers inserted between the pockets 90 and the partitions 40.

Figure 9:
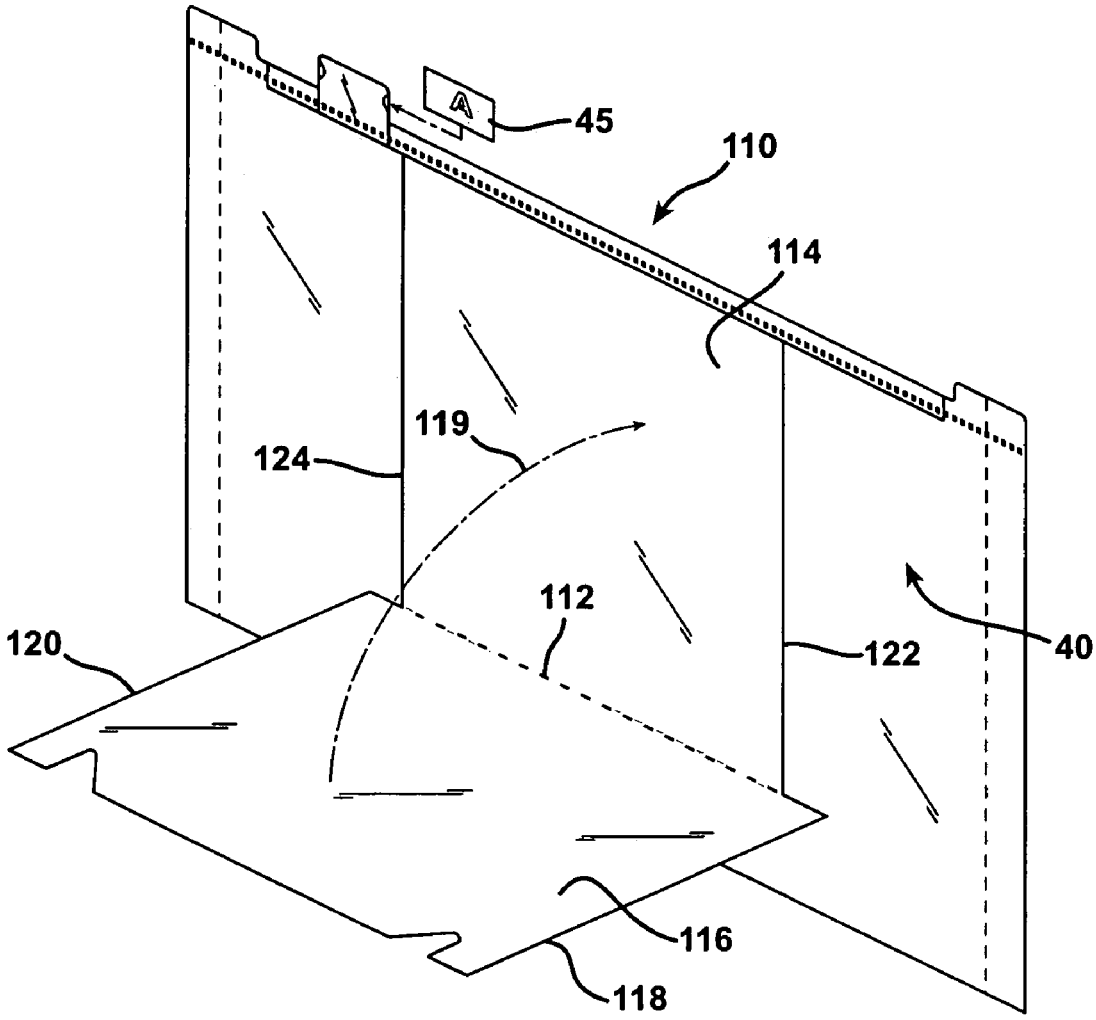
FIG. 9 is a perspective view illustrating another alternative embodiment of an improved file section divider according to the invention prior to completion of fabrication.
Figure 9A:
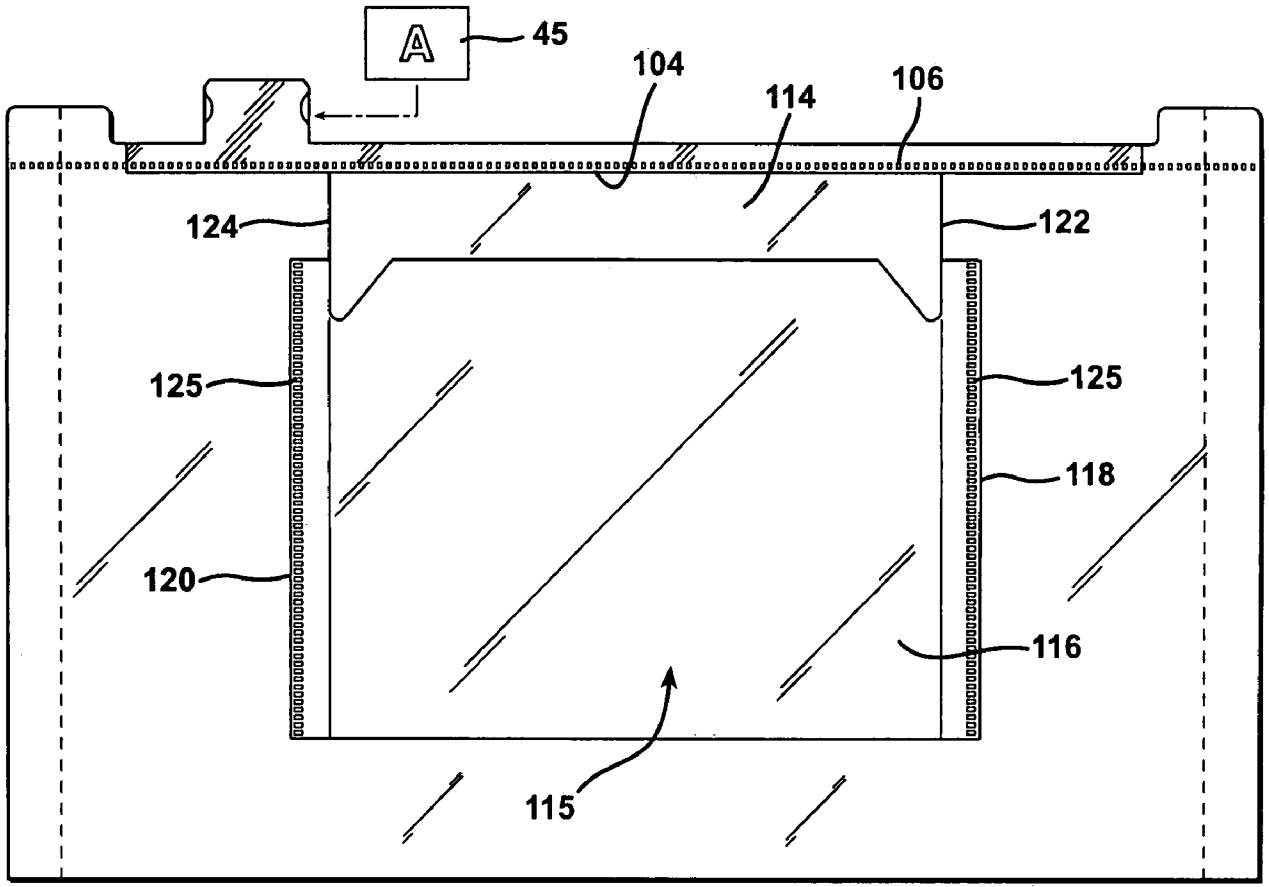
FIG. 9A is a front elevational view of the file section divider shown in FIG. 9 after completion of fabrication.

FIGS. 9 and 9A illustrate still another embodiment of the invention employing a file section divider 110. The file section divider 110 also includes a partition 40, which has the same construction as that depicted and described in conjunction with the embodiments of FIGS. 5, 8, and 8A. In addition, the file section divider 110 includes a second sheet of material in addition to the first sheet of material that forms the partition 40. This second sheet of material is folded along a bottom fold line 112 to delineate a backing panel 114 and an apron panel 116. In this embodiment the apron panel 116 is slightly wider than the backing panel 114. Consequently, the side edges 118 and 120 of each apron panel 116 are located outboard of the side edges 122 and 124 of the backing panel 114 formed of the same second sheet of material. Therefore, when the apron panel 116 is folded up toward the partition 40, as indicated by the directional arrow 119, the side edges 118 and 120 of each apron panel 116 project laterally outboard and beyond the side edges 122 and 124 of the corresponding backing panel 114. The apron panel side edges 118 and 120 are thereupon sealed to the partition 40 to form a pocket 115 by means of a pair of straight, linear, vertical sonic welds 125, located just inboard of the apron panel edges 118 and 120 and outboard from the backing panel side edges 122 and 124.

Like the file section divider 80, the backing panel 114 of the file section divider 110 has an anchoring margin 104 that is sealed to the partition 40 proximate its upper edge 42 by a laterally extending sonic weld 106. The pocket 115 is thereby secured to the file section divider partition 40 both at its top anchoring upper edge margin 104 of the backing panel 114 and at the side edges 118 and 120 of the apron panel 116.

Undoubtedly, numerous variations and modifications of the file section divider and portable document storage device of the invention will become readily apparent to those familiar with office filing products and office supplies. For example, while the backing panel 94 and the apron panel 96 are formed of a sheet of material separate from the sheet forming the partition 40 in the embodiment of FIGS. 8 and 8A, the backing panel could be formed as an extension from the upper edge of the partition 40 and the apron panel could be formed as an extension from the backing panel 94. The seal 106 would then be created just below the fold that forms a demarcation between the partition 40 and the backing panel 94. Accordingly, the scope of the invention should not be construed as limited to the specific embodiments depicted and described, but rather is defined in the claims appended hereto.

I claim:

1. In a file section divider formed as an expansive partition and having a laterally extending upper edge from which a file section label tab projects upwardly, an opposing laterally extending lower edge parallel to said upper edge, and mutually parallel opposing side edges oriented perpendicular to said upper and lower edges, the improvement comprising a pocket secured to said expansive partition and having a top opening located beneath the level of said label tab, wherein said partition is formed of a first sheet of material and said pocket is formed of a separate, second sheet of material, and said second sheet of material has an anchored edge parallel to and secured to said upper edge of said partition and said second sheet of material is folded back upon itself to form a pocket bottom fold parallel to said anchored edge, thereby delineating said pocket into an apron panel and a backing panel, both having opposing side edges parallel to said side edges of said partition, and said side edges of said apron panel and said backing panel reside in registration with each other and are sealed together, and said pocket is secured to said partition only at said anchored edge of said pocket.

2. In a file section divider formed as an expansive partition and having a laterally extending upper edge from which a file section label tab projects upwardly, an opposing laterally extending lower edge parallel to said upper edge and mutually parallel opposing side edges oriented perpendicular to said upper and lower edges, the improvement comprising a pocket secured to said expansive partition and having a top opening located beneath the level of said label tab, wherein said partition is formed of a first sheet of material and said pocket is formed of a separate, second sheet of material, and said second sheet of material has an anchored edge parallel to and secured to said upper edge of said partition and said second sheet of material is folded back upon itself to form a pocket bottom fold parallel to said anchored edge, thereby delineating said pocket into an apron panel and a backing panel, both having opposing side edges parallel to said side edges of said partition, and said side edges of said apron panel are located further from each other than said side edges of said backing panel and closer to each other than said side edges of said partition and said side edges of said apron panel are sealed to said partition so that said pocket is secured to said partition by said side edges of said apron panel as well as at said anchored edge of said second sheet of material.

3. An expandable filing case having a plastic front cover and a plastic back cover, both having a top and a bottom, plastic side panels extending between said front and back covers, each side panel having a plurality of accordion folded pleats formed therein, each pleat being formed with a pair of facing surfaces that are collapsible toward each other, and a plurality of plastic file section dividers having opposing mutually parallel, upper and lower divider edges and opposing mutually parallel outboard divider side edges oriented perpendicular to said upper and lower divider edges, and each of said section dividers has side edge margins extending between said upper and lower divider edges and located immediately adjacent to both of said divider side edges, and each of said side edge margins is sealed to a single one of said facing surfaces in said pair of facing surfaces formed by said pleats to create folded pleated connections, whereby said section dividers are coupled to said front and back covers by said side panels, and at least some of said file section dividers are provided with filing pockets secured thereto and located between said divider side edges, and each of said filing pockets has an upwardly opening mouth located no higher than said upper divider edges.

4. An expandable filing case according to claim 3 wherein each pocket is formed of a plastic extension panel projecting from a separate one of said dividers at said lower edge thereof and folded back against said one of said dividers and having pocket panel side edges parallel to said side edges of said separate one of said dividers, and said pocket panel side edges are secured throughout their lengths to said separate one of said dividers.

5. An expandable filing case according to claim 4 wherein said pocket panel side edges of said pouches are secured to said dividers by heat sealing.

6. An expandable filing case according to claim 4 wherein said pocket panel side edges are spaced inboard from said divider side edges.

7. An expandable filing case according to a claim 3 wherein said file section dividers are all formed of first sheets of flexible expansive material and said pockets are all formed of second sheets of flexible, expansive material secured to said first sheets.

8. An expandable filing case according to claim 7 wherein said second sheets of expansive material are all flat and have pocket panel bottom edges parallel to and located above said lower divider edges and opposing pocket panel side edges parallel to and located between said divider side edges, and said second sheets have open top edges.

9. An expandable filing case according to claim 7 wherein said second sheets are folded to form pocket backing panels and pocket apron panels delineated from each other by a pocket bottom folds parallel to and located above said lower divider edges, and said backing panels and said apron panels both have opposing side edges parallel to and located laterally between said divider side edges.

10. An expandable filing case according to claim 9 wherein said backing panel side edges and said apron panel side edges are aligned in mutual registration and are sealed to each other and said backing panels have top anchoring margins that are sealed to said dividers at said upper edges thereof.

11. An expandable filing case according to claim 9 wherein said side edges of said apron panels are located outboard of said side edges of said backing panels, and are sealed to said dividers and said backing panels have top anchoring edges sealed to said dividers at said upper edges thereof.

12. An expandable filing case according to claim 3 wherein said filing pockets are formed from extensions of said section dividers at said lower edges thereof folded back up toward said upper edges of said dividers, and said extensions have pocket side edges sealed to said section dividers.

13. An expandable filing case according to claim 3 wherein said filing pockets and said dividers are formed from separate sheets of expansive material secured together.

14. An expandable filing case according to claim 3 wherein each of said divider side edge margins is secured to said single one of said facing surfaces in said pair of facing surfaces by heat-sealing.

15. An expandable filing case according to claim 3 wherein each of said divider side edge margins is secured to said single one of said facing surfaces in said pair of facing surfaces by sonic welding.

* * * * *